United States Patent [19]

Mayes et al.

[11] Patent Number: 4,823,145

[45] Date of Patent: Apr. 18, 1989

[54] CURVED MICROSTRIP ANTENNAS

[75] Inventors: Paul E. Mayes; David R. Tanner, both of Champaign, Ill.

[73] Assignee: University Patents, Inc., Westport, Conn.

[21] Appl. No.: 906,852

[22] Filed: Sep. 12, 1986

[51] Int. Cl.[4] ..... H01Q 1/36

[52] U.S. Cl. ..... 343/895; 343/700 MS

[58] Field of Search ..... 343/895, 700 MS

[56] References Cited

U.S. PATENT DOCUMENTS

| | | | |
|---|---|---|---|
| 3,555,554 | 1/1971 | Kuo | 343/895 |
| 3,656,168 | 4/1972 | Stropki | 343/895 |
| 3,717,877 | 2/1973 | Hanninen et al. | 343/895 |
| 3,717,878 | 2/1973 | Mosko | 343/895 |
| 3,787,871 | 1/1974 | Reese | 343/895 |
| 4,095,230 | 6/1978 | Salmond et al. | 343/895 |
| 4,630,064 | 12/1986 | Andrews et al. | 343/895 |
| 4,636,802 | 1/1987 | Middleton | 343/895 |

*Primary Examiner*—William L. Sikes
*Assistant Examiner*—Robert E. Wise
*Attorney, Agent, or Firm*—David N. Koffsky; George M. Yahwak

[57] ABSTRACT

A thin planar curved microstrip antenna is described which exhibits substantially constant input impedance characteristics over a wide frequency band. The impedance characteristic is achieved by shaping the ground surface such that the ratio of the width of the radiating element to its distance from the ground surface stays constant for a given curvature.

7 Claims, 4 Drawing Sheets

CURVED MICROSTRIP ANTENNAS

FIELD OF THE INVENTION

This invention relates to antennas and more particularly to curved microstrip antennas of a planar variety which radiate or receive electromagnetic waves of circular polarization over a wide band of frequencies.

BACKGROUND OF THE INVENTION

In the last decade, antennas constructed using printed circuit techniques have become popular especially for mobile applications. These antennas are often thin and can be affixed to a vehicle, aircraft, etc. without appreciably altering the aerodynamics of the host structure.

The printed circuit antennas of the prior art are often of the resonant type. In such antennas, the input impedance varies widely with a change of energizing frequency, which frequency is in the vicinity of the frequency of resonance. This thereby severly limits the antenna's operating bandwidth typically limiting it to only a few percent of the resonant frequency.

To overcome these limitations, others have constructed non resonant, travelling wave printed circuit antennas from microstrip lines. For instance, see "Curved Microstrip Lines as Compact Wideband Circularly Polarized Antennas" by C. Wood, *IEE Journal, Microwaves, Optics and Acoustics,* January 1979, Volume 3, No. 1, Pages 5–13. Wood describes various antennas with conducting strip geometry of both constant and varying width overlying closely spaced flat ground planes. Wood's antennas develop their radiating field between the plane of the microstrip and the ground plane and radiate circularly polarized waves. The method used by Wood to excite his antennas is to attach the center conductor of a coaxial cable to the conducting strip at some location on the strip and to connect the outer conductor to the ground plane. As a consequence there is an abrupt change in geometry at the connection which has a deleterious effect on the input impedance as a function of frequency, thus limiting the operating bandwidth.

It can be shown that the characteristic impedance of a strip line conductor is a function of the ratio of the width of the strip to its height above the ground surface. Thus, if the width of a strip conductor varies substantially along its length while maintaining a constant height over the ground plane, its characteristic impedance may vary in an unacceptable manner. On the other hand, if the aforementioned width to the height ratio remains constant, then the characteristic impedance of the antenna structure remains essentially constant as the wave moves along the structure.

Accordingly, it is an object of this invention to provide a microstrip antenna which exhibits an impedance characteristic that remains nearly constant over a wide band of applied frequencies.

It is a further object of this invention to provide a microstrip antenna of thin dimension capable of being mounted on vehicles and other moving conveyances.

It is a further object of this invention to provide a curved microstrip antenna of thin configuration which is adapted to both transmit and receive signals of a circular polarization.

SUMMARY OF THE INVENTION

The present invention employs a curved, thin planar strip of conductive material and a closely spaced conducting ground surface. In one version, the conducting strip is of a varying width being quite small at one extremity (the "tip") and expanding to quite wide at its far extremity. An electromagnetic field is established between the tip and the ground surface by an external source, which field acts to launch a wave down the strip. The wave so launched is guided so that its energy is confined mostly to the region between the strip conductor and the ground surface. The curvature of the strip induces in the fringing field along its outer edge, a phase velocity greater than the velocity of a plane wave in free space. As a result, the field loses energy rapidly to the surrounding space and its amplitude along the strip diminishes with increasing distance from the tip. After the wave has propagated along the strip for a sufficient distance, its amplitude is essentially zero and it thus becomes possible to terminate the strip conductor without producing a reflected wave. Importantly, the distance between the ground surface and the strip is caused to vary so that the ratio of the strip's width to its height from the ground surface remains substantially constant for a given curvature, with the result being that the impedance along the strip remains essentially constant over a wide band of frequencies.

The shape of the antenna's radiation pattern is controlled by the phase shift per degree of rotation along the outer edge of the strip conductor. When the ratio of degrees of phase shift per degree of rotation around the strip conductor is near unity, the pattern is circularly polarized and has a single lobe exhibiting a peak value normal to the plane of the strip conductor.

DETAILED DESCRIPTION OF THE INVENTION

Figure 1:
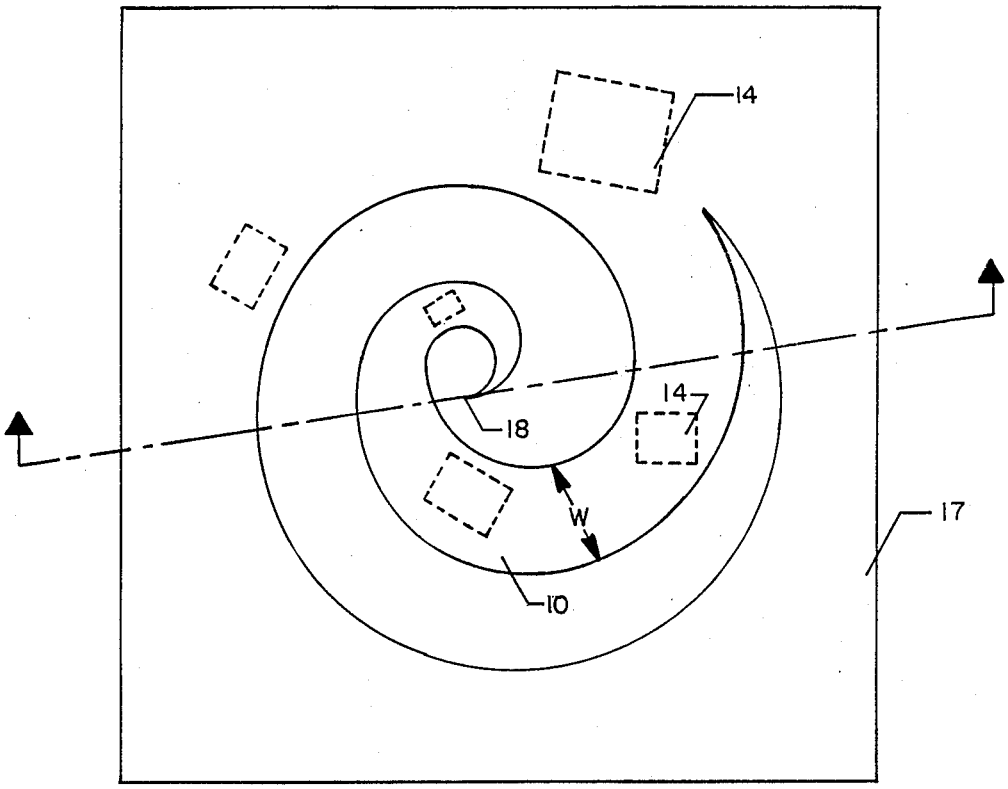
FIG. 1 is a plan view of the antenna showing a strip conductor of expanding width.
Figure 2:
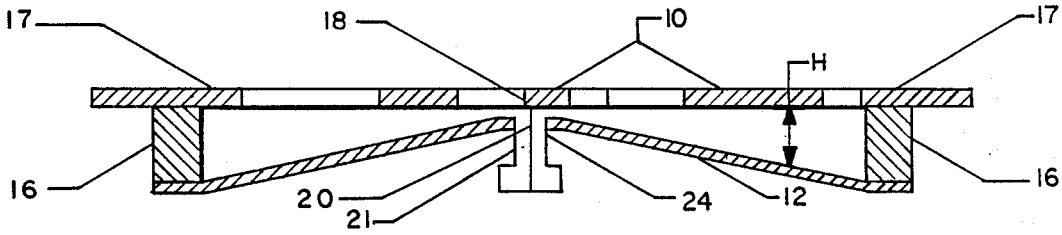
FIG. 2 is a sectional view of the antenna of FIG. 1 taken along line A—A.

Referring now to FIGS. 1 and 2, the antenna is comprised of strip conductor 10 and a closely spaced, conically shaped ground surface 12. Strip conductor 10 merges with an extended conducting plane 17 at a constant radial distance from tip 18. The upper antenna structure comprised of strip conductor 10 and conducting plane 17 is supported around its periphery by vertical walls 16 which extend between ground plane 12 and conducting plane 17. Strip conductor 10 is also held in position by support members 14 (not shown in FIG. 2) which are made from an appropriate dielectric material. Tip 18 is electrically connected to center conductor 20 of coaxial cable 21. The outer conductor 24 of coaxial cable 21 is connected directly to ground surface 12 at the apex of its conical shape. Except for conducting strip 10, all members of FIG. 2 are rotationally symmetric.

It should be noted that the slope of ground surface 12 is chosen so that the ratio of the distance H between strip conductor 10 and ground surface 12 and the width W of strip conductor 10 remains substantially constant. Thus, as the width W of strip conductor 10 increases, so also does the distance H of strip conductor 10 from ground plane 12. This relationship is required for maintenance of the desired constant impedance characteristic of the antenna. It should be noted that the curvature of strip conductor 10 has a limited effect on its characteristic impedance, however it may be neglected for first approximations of antenna design.

Figure 3:
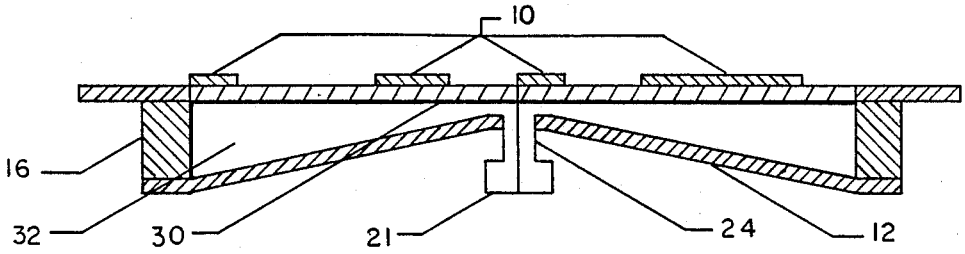
FIG. 3 is a cross section of the antenna of FIG. 1 wherein a dielectric substrate supports the strip conductor.

Alternatively, as shown in FIG. 3, strip conductor 10 can be supported by a thin layer of dielectric 30. This allows the use of printed circuit techniques to fabricate strip conductor 10. Dielectric layer 30 may be supported by a dielectric material which fills all or part of the region 32 between dielectric layer 30 and ground plane 12 or, in the alternative, it may be supported by individual foam blocks 14 as shown in FIG. 1.

Figure 4:
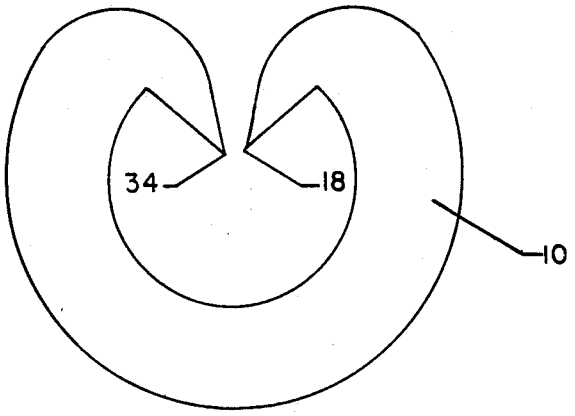
FIG. 4 is a top view of a two port version of the antenna which provides both senses of circular polarization.
Figure 5:
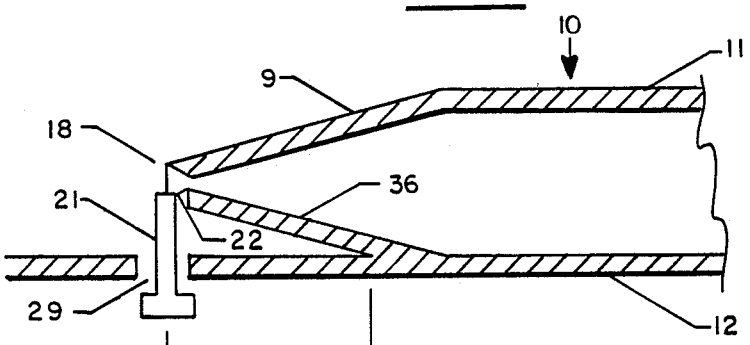
FIGS. 5*a* and 5*b* illustrate an alternative construction of the invention wherein the conducting strip is of constant width but a strip of expanding width is employed to launch the wave from a coaxial connector.
Figure 5:
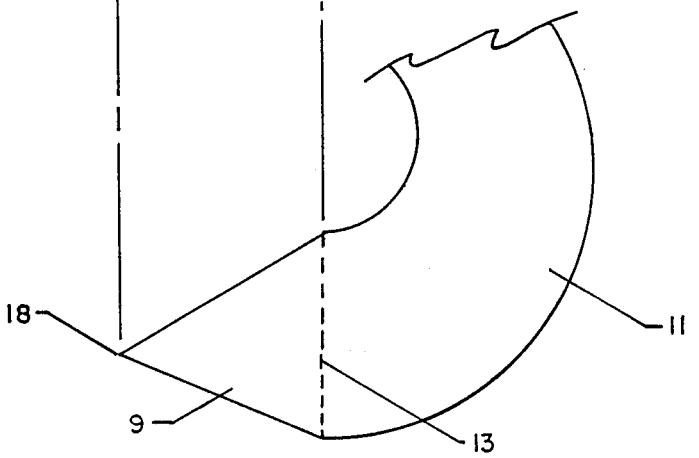

In FIG. 4 an alternative structure is shown wherein tips 18 and 34 are provided on respective extremities of strip conductor 10. Each tip can be attached to a coaxial cable in the manner shown in FIG. 2. Placing a matched termination at tip 34 will substantially eliminate any reflection at that point for a wave that is initiated at tip 18. The converse is also true. The radiation pattern from the antenna, when excited at tip 18, will have one sense of polarization whereas when the antenna is excited at tip 34 the pattern will exhibit an opposite polarization senses. The relationship of ground surface 12 to tip 18 (of FIG. 4) is shown in FIGS. 5*a* and 5*b*. A similar geometry exists in the vicinity of tip 34 of FIG. 4.

In FIG. 5*b*, strip conductor 10 is comprised of two regions, region 9 which is a thin conductor of essentially triangular shape and region 11 which is a curved strip conductor of constant or nearly constant width. The two regions are joined along junction line 13. Coaxial cable 21 is shown with its center conductor attached to tip 18 of conductor 9. The outer conductor of coaxial connector 21 is attached to conical section 36 of ground surface 12. The conical shaped surface 36 extends only to a point just below the junction between regions 9 and 11 of conductor 10. Ground surface 12, in this case, extends across the entire structure with only an access hole 29 being provided for coaxial connector 21. Conical ground surface 36 need not extend through a complete rotation of 360° but may be limited in angle to directly beneath conductive portion 9.

Figure 6:
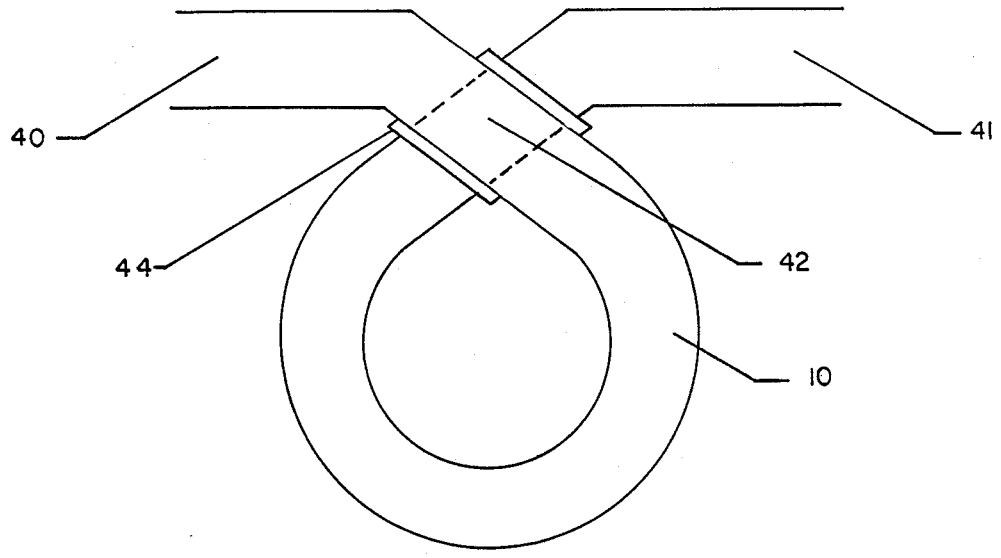
FIG. 6 is a top view of a multilayer two port antenna which produces a symmetrical circularly polarized wave.

It may occur, particularly when the antenna is to be used as an element in a series-fed array, that it is desired to feed the strip conductor 10 through the use of microstrip feed lines. Such a configuration is shown in FIG. 6. In this instance, strip conductor 10 continues through a greater portion of a circular arc and, in fact, overlaps where transitions are made to feed lines 40 and 41. In the overlap region 42, the upper portion of the strip conductor is insulated from the lower portion by a thin dielectric sheet 44.

Figure 7:
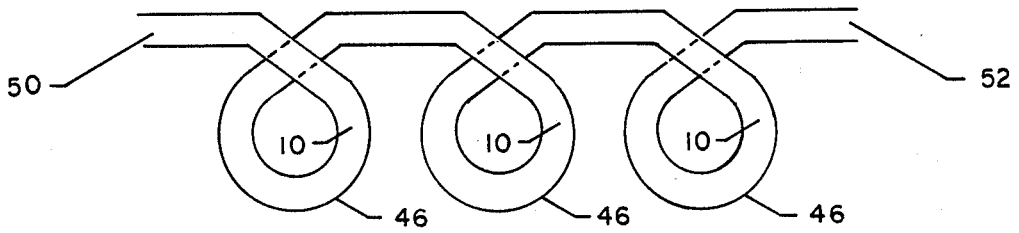
FIG. 7 is a top view of an array of the antennas of FIG. 6.

A method for attaching the antenna of FIG. 6 to form a linear array is shown in FIG. 7. The array of antennas 46 can be attached to external circuitry at either left port 50 or right port 52. Assuming that the impedance of the external circuits are matched to the microstrip at each port, both senses of polarization will be radiated; one sense by a generator connected to port 50, the other sense by a generator connected to port 52. When only one sense of polarization is desired, the unused port can be connected to a matched termination to eliminate reflections although the array can be designed so that very little energy is present at that port. The amount of energy radiated by each element can be varied by changing the width of conductive strip 10 or the size of the element relative to the wave length. Thus it is possible to obtain a desired source distribution over the array length and thereby produce desired properties in the radiation pattern.

Figure 8:
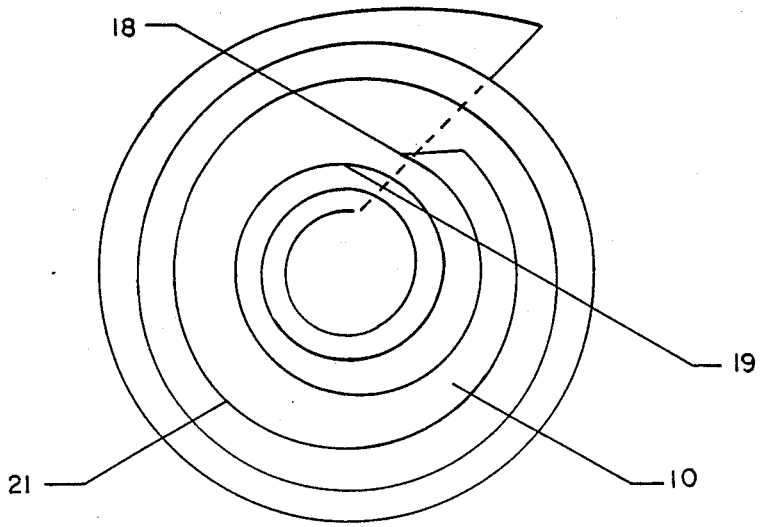
FIGS. 8*a* and 8*b* are top and cross sectional views of a multi-turn version of an antenna that provides operation over a wider band than the single turn antenna of FIG. 7 but yet retains much of the compact nature of the single turn antenna.
Figure 8:
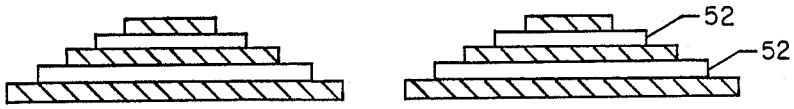

The greater the length of conductive strip 10, (possibly resulting in several turns) the smaller the lower boundary on the frequency of operation. In FIG. 6, conductive strip 10 is shown continuing only for one and a fraction turns, all located in essentially the same plane. The area required for a multi-turn antenna can be reduced by allowing the turns to overlap as shown in FIGS. 8*a* and 8*b* wherein strip conductor 10 makes three revolutions. The overlapping turns are separated by a thin layer of dielectric 52. An electromagnetic wave is launched at tip 18 in the region between the tip and location 19 immediately below the tip. The next lower turn of the strip therefore corresponds to the ground surface for each turn of strip conductor 10. Hence no separate ground surface is required.

Figure 9:
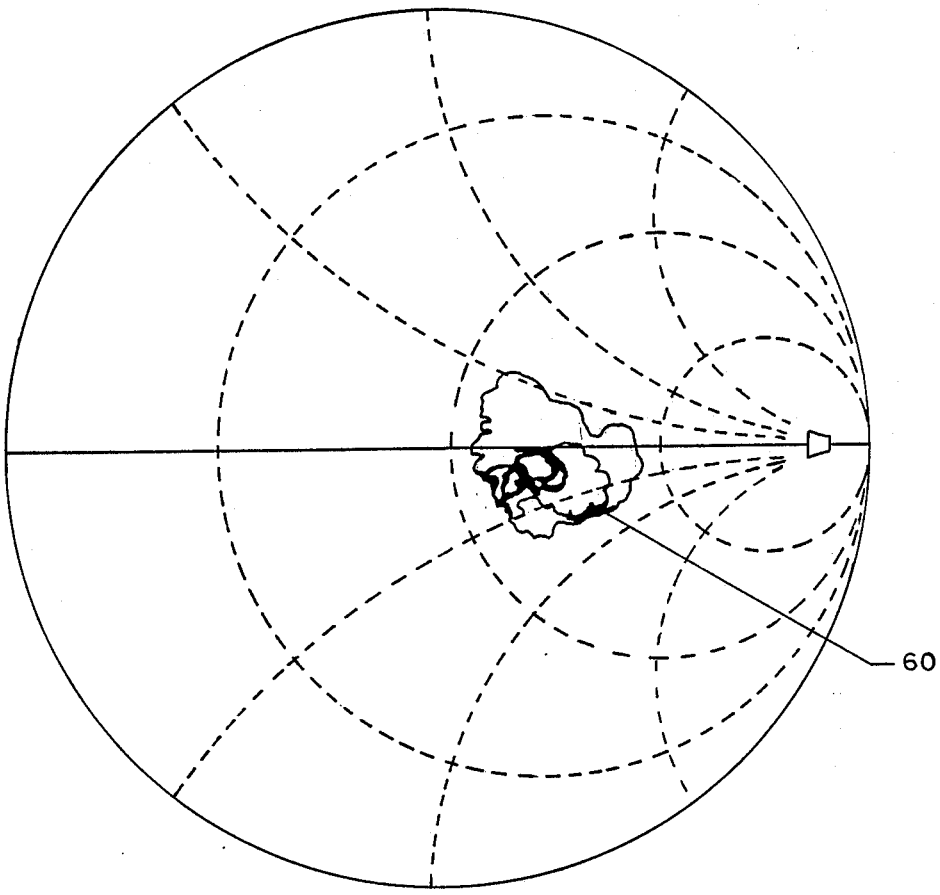
FIG. 9 is a Smith chart plot of the input impedance of one model of the antenna measured over a 4 to 1 frequency ratio.

As aforestated, the characteristic input impedances of the antennas of this invention are subtantially determined by the ratio of the width of strip conductor 10 to the distance between strip conductor 10 and ground surface 12. The variation of the impedance measured at tip 18 of an antenna similar to that shown in FIGS. 1 and 2 is illustrated on a Smith Chart plot shown in FIG. 9. The near constant value of impedance over a frequency band from 3 to 12 GHz is illustrated by the small locus 60 of the measured data shown in the chart.

We claim:

1. A low profile antenna adapted to send and/or receive circuitry polarized waves and constructed so as to exhibit a substantially constant input impedance over a predetermined frequency range, the combination comprising:

a ground surface, at least a section of which is conically shaped;

a single strip conductive means positioned over said ground surface, a portion of said conductive means exhibiting a gradually increasing width from a feed point, said portion juxtaposed over said conically shaped section of said ground surface; and signal feed means connected to said feed point.

2. The invention of claim 1 wherein said gradually increasing width portion of said strip conductive means is designated W at any point along its length and said conically shaped section of said ground surface slopes away from said strip conductive means, being closest thereto at said feed point, a vertical distance between said ground surface and said strip conductive means being designated H.

3. The invention of claim 2 further including means to fixedly support said strip conductive means over said ground surface whereby the ratio of said distance H to said width W remains substantially constant over said conically shaped portion of said ground surface.

4. The invention of claim 3 wherein said feed means is a coaxial cable, the center conductor thereof being connected to said feed point of said strip conductive means and the outer shield of said coaxial cable being connected to said ground surface means.

5. The invention as defined in claim 4 wherein said strip conductive means is spiral shaped.

6. The invention as defined in claim 5 wherein said strip conductive means spiral overlaps itself.

7. The invention as defined in claim 3 wherein said strip conductive means has point-like terminations at either extremity, each having a coaxial feed connected thereto.

* * * * *